US008357207B2

(12) United States Patent
Strijbos

(10) Patent No.: US 8,357,207 B2
(45) Date of Patent: Jan. 22, 2013

(54) LEATHER TREATMENT AND AGENT

(75) Inventor: Leonardus Strijbos, Neuenburg am Rhein (DE)

(73) Assignee: TFL Ledertechnik GmbH, Weil am Rhein (DE)

( * ) Notice: Subject to any disclaimer, the term of this patent is extended or adjusted under 35 U.S.C. 154(b) by 377 days.

(21) Appl. No.: 12/085,562

(22) PCT Filed: Nov. 27, 2006

(86) PCT No.: PCT/EP2006/068942

§ 371 (c)(1), (2), (4) Date: May 28, 2008

(87) PCT Pub. No.: WO2007/063047

PCT Pub. Date: Jun. 7, 2007

(65) Prior Publication Data

US 2009/0249554 A1 Oct. 8, 2009

(30) Foreign Application Priority Data

Nov. 29, 2005 (CH) ..... 1896/05

(51) Int. Cl.

| | |
|---|---|
| ***C14C 11/00*** | (2006.01) |
| ***C14C 3/06*** | (2006.01) |
| ***C14C 3/28*** | (2006.01) |
| ***C14C 3/32*** | (2006.01) |
| ***C14C 3/08*** | (2006.01) |

(52) U.S. Cl. ..... 8/94.21; 8/94.1 R; 8/94.19 R; 8/94.2; 8/94.27

(58) Field of Classification Search ..... 510/276; 526/287; 252/8.57; 8/94.1 R, 94.2, 94.21, 8/94.27, 94.19 R See application file for complete search history.

(56) References Cited

U.S. PATENT DOCUMENTS

| | | | | |
|---|---|---|---|---|
| 4,348,201 | A * | 9/1982 | Hayashi et al. | 8/94.18 |
| 5,895,781 | A | 4/1999 | Neumiller et al. | |
| 5,910,475 | A | 6/1999 | Neumiller et al. | |
| 6,207,780 | B1 * | 3/2001 | Stockhausen et al. | 526/287 |
| 2007/0022541 | A1 * | 2/2007 | Taeger et al. | 8/94.16 |

FOREIGN PATENT DOCUMENTS

| | | | |
|---|---|---|---|
| EP | 1 022 344 | | 7/2000 |
| GB | 1 520 980 | | 8/1978 |
| WO | 99/37172 | | 7/1999 |
| WO | 02/00942 | | 1/2002 |
| WO | WO 2004/037589 | * | 5/2004 |

OTHER PUBLICATIONS

International Search Report issued Apr. 5, 2007 in the International (PCT) Application PCT/EP2006/068942 of which the present application is the U.S. National Stage.

PCT Written Opinion for International (PCT) Application No. PCT/EP2006/068942 of which the present application is the U.S. National Stage.

* cited by examiner

*Primary Examiner* — Lorna M Douyon
*Assistant Examiner* — Amina Khan
(74) *Attorney, Agent, or Firm* — Wenderoth, Lind & Ponack, L.L.P.

(57) ABSTRACT

D-Isoascorbic acid or one of its salts, as such or as a constituent of a liquid or solid formulation, is an effective agent for reducing the amount of Cr(VI) compounds in leathers tanned with Cr(III) salts by treatment of the leather in an aqueous liquor after tanning or finishing or of a commodity article with an aqueous solution.

9 Claims, No Drawings

LEATHER TREATMENT AND AGENT

The present invention relates to a process for reducing Cr(VI) formation in leathers tanned with Cr(III) salts by treating the leather with D-isoascorbic acid, the use of D-isoascorbic acid for reducing Cr(VI) formation in chrome-tanned leathers, and a composition comprising at least one surfactant and D-isoascorbic acid.

Large amounts of chromium(III) salts are used for tanning leather. Depending on the manner in which the process is carried out and the agents used, however, critical amounts of soluble Cr(VI) compounds which are known to be toxic and are also considered to be allergens and carcinogens, form in the course of tanning in the multi-stage tanning process.

Since Cr(VI) compounds, in contrast to Cr(III) compounds, are easily absorbed by the body via the skin, Cr(VI) compounds are permitted to be present in commodity articles only in very small amounts.

Here, in particular apparel and footwear (for example, jackets, waistcoats, shirts, trousers, hats, scarves, gloves, low shoes, sandals, boots), coverings for seating and automotive seats, claddings for dashboards, steering wheel, roof and doors in cars, and accessories (for example, rucksacks and handbags) may be mentioned as commodity articles.

Since the tanning of leather is to date still carried out predominantly with Cr(III) salts, there is a need to solve the problem of the formation of Cr(VI) compounds in the production and use of leather articles. The formation of Cr(VI) compounds in the production of leather is due to the action of oxidizing agents, for example atmospheric oxygen, and the agents used for leather production. On the other hand, it is known that Cr(VI) compounds also form during the use of leather articles, for example work gloves. Perspiration is mentioned as a possible cause for this in the literature.

Accordingly, the Cr(VI) formation must be avoided in the leather production itself and in completely finished leather articles by using auxiliaries which counteract oxidation of Cr(III) salts. These agents may be those which are familiar under the functional terms antioxidants, free radical scavengers, light stabilizers, quenchers and UV absorbers.

In the publication "Formation, Prevention & Determination of Cr(VI) in Leather" (September 2000), published by UNIDO (United Nations Industrial Development Organization) under the project number US/RAS/92/120, the literature on the subject of Cr(VI) formation is summarized up to and including the year 2000. Information as to how the formation of Cr(VI) compounds could be avoided in leather production is also given. Thus, using as far as possible no natural oils as fatliquoring agents, because such unsaturated fats and oils tend to form free radicals under the influence of light and these free radicals can oxidize Cr(III) to Cr(VI), is mentioned.

The disclosure of DE 198 60 610 A1 aims exactly in this direction since it proposes the use of fatliquoring agents to which at least one antioxidant has been added. For example, ascorbic acid, bisphenol derivatives, carotenoids, gallic acid and lecithins are mentioned as possible antioxidants. In the examples, the antioxidants actually used are not mentioned.

A disadvantage of this procedure is that the antioxidant must be tailored with respect to amount and in its compatibility to the fatliquoring agent and moreover is limited to the production process and there to the fatliquoring step or steps.

The disclosure of DE 100 28 142 A1 proposes the use of an antioxidant-containing dispersion. The members of the classical sterically hindered phenols, such as, 2,2'-methylenebis (2,6-di-tert-butylphenol), are mentioned as possible antioxidants. Since they are not water-soluble, these are used as a constituent of aqueous dispersions. The dispersions are used during the steps of pickling and/or of tanning, or should be added to the tanning liquor no later than towards the end of the tanning.

Gallic acid already mentioned as a possible antioxidant in DE 198 60 610 A1 is proposed in DE 100 31 548 A1 for stabilizing leathers tanned with Cr(III) salts, since it is said to effect effective stabilization of Cr(III) without adversely affecting the performance characteristics. It is also proposed using gallic acid in combination with reducing agents or in combination with free radical scavengers, such as vitamin C and E, sterically hindered phenols or amines. The gallic acid, also in the form of its salts, can be used in all stages of leather production, but preferably instead of vegetable tanning agents in the course of retanning.

WO 02/000942 combines the stabilization Cr(III) with replacement of vegetable retanning agents. The use of hydrolysis products of vegetable tanning agents in the course of retanning for stabilizing leathers tanned with Cr(III) salts is proposed. The hydrolysis products are said to have better efficiency with respect to the Cr(III) stabilization in combination with better fullness and colourability of the finally produced leather than is the case with direct use of vegetable tanning agents.

It is known that L-ascorbic acid decomposes and becomes discoloured under the action of light and/or heat. From our own investigations, it is known that the treatment of leathers tanned with Cr(III) salts with L-ascorbic acid leads to substantial and undesired reddish discolourations on ageing of the leathers. Initially colourless, e.g. 10% strength, aqueous solutions of L-ascorbic acid exhibit substantial yellowish discolourations at room temperature after 3 weeks. On heating to 100° C., this effect is found after only 24 hours.

It was an object of the present invention to provide an agent for stabilizing Cr(III) and reducing the amount of Cr(VI) in chrome-tanned leathers, which can be added in any stage of leather production after tanning with Cr(III) salts, in particular in the last wash stage of wet finishing. This also means that the agent is not tied to a process-related combination, for example to a tanning agent or fatliquoring agent. Thus, disadvantages which arise out of the necessary tailoring with respect to concentration and mutual compatibility of the substances to be combined with one another are avoided. Furthermore, the agents should be suitable for effective after-treatment of leather articles (in particular apparel and shoes) in order to remove Cr(VI) compounds present, and thus to counteract destruction of such articles owing to reservations on health grounds. The leathers treated with the agent should additionally be stable to ageing and should not lead to discolouration.

It has surprisingly been found that D-isoascorbic acid (erythorbic acid), an optical isomer of vitamin C or L-ascorbic acid, is outstandingly suitable as an agent for stabilizing leather tanned with Cr(III) salts, although D-isoascorbic acid is even less stable to ageing than L-ascorbic acid and tends to give brownish, coloured solutions in the ageing test. D-isoascorbic acid is even very economical with regard to the agent and the treatment.

The present invention firstly relates to a process for reducing the amount of Cr(VI) compounds in leathers tanned with Cr(III) salts, characterized in that, after the tanning, at least 0.8% by weight of D-isoascorbic acid or of one of its salts is allowed to act in aqueous liquor on the leather, based on the shaved weight of the leather.

A chrome-tanned leather treated according to the invention with D-isoascorbic acid preferably has a Cr(VI) content of less than 3 mg/kg, based on the dry substance of a leather which is initially air-dried and subsequently heat-treated for 72 hours at 100° C. 3 mg of Cr(VI) per kg of dry substance corresponds to the limit of detection for Cr(VI) for a determination of Cr(VI) carried out according to DIN 53314, the leather sample being tested in the milled state for chromate. The treatment for 72 hours at 100° C. is intended to simulate climatic and other application-related influences which may promote the formation of Cr(VI) compounds over a relatively long period (accelerated ageing).

In order to achieve or to remain below the limit of detection of 3 mg of Cr(VI) per kg of dry substance according to the accelerated ageing described above, an amount of at least 0.8, preferably at least 1.0, more preferably at least 1.2 and particularly preferably at least 1.5% by weight of D-isoascorbic acid or of one of its salts is added to the liquor. The amount of D-isoascorbic acid or of one of its salts may be up to 10% by weight or more, a preferred upper limit being 8% by weight and particularly preferably 6% by weight, based on the shaved weight of the leather.

In principle, after tanning with Cr(III) salts, D-isoascorbic acid or one of its salts may be added to the liquor at any desired point in the further processing to give the finished leather, for example the retanning, fatliquoring and the dyeing, or wash stages in between.

The addition of the agent can be effected in proportions in different process stages and/or wash steps or preferably by a single addition in one of the steps. The simplest, most effective and therefore also preferred addition is effected at the end of the wet treatment (also designated as "wet end"), i.e. after fixing on final washing of a finally finished leather.

If D-isoascorbic acid or one of its salts is added in one of the wash stages, the liquor length of the wash stage should be about 50-150% of water here and the water temperature should expediently be 15 to 30° C., preferably 20-25° C. An expedient contact time at said temperatures should be about 30 minutes, since very good results are achieved thereby.

D-isoascorbic acid as an agent can be used per se or in the form of its water-soluble salts, for example as ammonium or alkali metal salts. Examples of alkali metals are lithium, sodium and potassium. Examples of ammonium are $NH_4^+$ and methyl-, ethyl-, propyl-, butyl-, hydroxyethyl-, dimethyl-, diethyl-, dihydroxyethyl-, trimethyl-, triethyl- and trihydroxyethylammonium.

The use of sodium isoascorbate is particularly preferred.

D-isoascorbic acid and the salts mentioned are advantageously water-soluble solids. D-iso-ascorbic acid or one of its salts can therefore be added directly as solid or in formulated form to the liquor. Possible formulation constituents for a formulation which is solid at room temperature are surfactants, standardizing agents and auxiliaries. Such a solid formulation can also be used in the form of its solutions or concentrates, preferably based on water.

Such solid formulations contain the D-isoascorbic acid or one of its salts expediently in an amount of 20 to 90% by weight, based on the total composition.

Examples of inert standardizing agents are mainly water-soluble salts, in particular alkali metal and ammonium salts of inorganic or organic acids. Suitable alkali metal and ammonium cations have been mentioned above. Suitable anions of acids are chloride, sulphate, hydrogen sulphate, carbonate, bicarbonate, formate, acetate, malonate and oxalate. A particularly preferred standardizing agent is sodium sulphate. It is also possible to use mixtures of standardizing agents.

A considerable variety of suitable surfactants is known. They may be non-ionic, anionic, cationic and zwitterionic surfactants.

The zwitterionic surfactants may be amine oxides, imidazoline carboxylates, betaines or aminocarboxylic acids.

Nonionic surfactants are, for example polyoxyalkylene, in particular polyoxyethylene and/or polyoxypropylene, esters, ethers and thioethers of fatty acids, fatty alcohols and long-chain thiols, which contain on average preferably 2 to 100 oxaalkylene units. In general, they are ethoxylates, i.e. fatty alcohol ethoxylates, oxo alcohol ethoxylates and fatty acid ethoxylates. Further examples are propylene oxide/ethylene oxide polyadducts, alkyl polyglycosides, fatty acid alkylolamides and fatty acid alkylolamide oxyethylates.

Cationic surfactants are, for example ammonium salts having N-bonded long-chain hydro-carbon radicals with lower alkyl groups or hydroxyalkyl groups optionally bonded to the N atom.

The anionic surfactants may be organic compounds having an acid group as a hydrophilic radical and a hydrocarbon radical optionally interrupted by heteroatoms from the group consisting of S, NR and preferably O as a hydrophobic radical, it being possible for the hydrophobic radical to contain 8 to 50 and preferably 8 to 30 C atoms and optionally heteroatoms. Suitable acids are, for example, phosphonic acids, phosphonous acid, sulphonic acids, sulphinic acids, monosulphates, mono- and diphosphates and preferably carboxylic acids. The acids are generally used in neutralized form, for example as alkali metal, alkaline earth metal or ammonium salts. Examples of salts are lithium, sodium, potassium, ammonium, methylammonium, ethylammonium, dimethylammonium, diethylammonium, trimethylammonium, triethylammonium or mono-, di- or triethanol-ammonium salts. Carboxylic acids or sulphonic acids and salts thereof are preferred.

Among the anionic surfactants, $C_8$-$C_{30}$-acylamidocarboxylic acids or -sulphonic acids, $C_8$-$C_{24}$-alkyl or -alkenyl ether carboxylic acids or mono- or di-$C_4$-$C_{24}$-, preferably di-$C_4$-$C_{24}$-alkyl- or -alkenylaryl ether carboxylic acids have proved particularly useful in leather treatment.

Acylamidocarboxylic acids are commercially available. They are preferably $C_8$-$C_{22}$-acyl-amidocarboxylic acids and particularly preferably $C_{10}$-$C_{20}$-acylamidocarboxylic acids. The acyl radical is preferably alkyl- or alkenyl-CO. The amidocarboxylic acids preferably contain 2 to 6 and particularly preferably 2 to 4 C atoms and an amino group bonded in the β- and particularly in the α-position relative to the carboxyl group. The amino group may be alkylated, for example with $C_1$-$C_4$-alkyl, such as methyl or ethyl. The use of sarcosides, which are likewise preferred according to the invention, has become established in leather treatment. Known examples are N-oleoylsarcosine, N-stearoylsarcosine, N-lauroylsarcosine and N-isononanoylsarcosine. Further examples of known acylamidocarboxylic acids are fatty acid amidoethyl-N-(2-hydroxyethyl)aminopropionic acid, methylcocoyltaurine, methyl-oleoyltaurine, N-lauroylethylenediaminetriacetic acid and N-cocoyl-L-glutaric acid. The acylamidocarboxylic acids are generally used in neutralized form, for example as alkali metal or ammonium salts, such as sodium, potassium, ammonium or mono-, di- or triethanol-ammonium salts.

Ethercarboxylic acids are likewise known surfactants. Ethercarboxylic acids may correspond to the following formula $R_1$—O[CH($R_2$)—$CH_2$—O]$_x$—$C_yH_{2y}$—COOH, in which $R_1$ denotes linear or branched $C_8$-$C_{24}$-alkyl or -alkenyl, preferably $C_8$-$C_{22}$-alkyl or $C_8$-$C_{22}$-alkenyl, or mono- or di-$C_4$-$C_{24}$-alkylaryl, preferably di-$C_4$-$C_{12}$-alkylaryl, $R_2$ represents H, methyl or ethyl, x denotes a number from 1 to 20 and y denotes a number from 1 to 6 and preferably 1 to 4.

$R_1$ as alkyl and alkenyl preferably contains 12 to 22 and particularly preferably 12 to 18 C atoms. A few examples are dodecyl, tetradecyl, hexadecyl, octadecyl and oleyl. The alkyl group or alkyl groups in the alkaryl radical preferably contains or contain 6 to 12 C atoms. Examples are butyl, pentyl, hexyl, octyl, decyl and dodecyl.

$R_2$ preferably represents methyl and particularly preferably hydrogen.

In the formula, x preferably represents a number from 1 to 12 and particularly preferably from 1.5 to 8.

In the formula, y preferably represents the numbers 1 or 2 and particularly preferably 1.

A mixture of different surfactants may also be used.

Nonionogenic and/or anionic surfactants are preferably used.

Preferred anionic surfactants are alkylbenzenesulphonates and ethercarboxylic acids.

Preferably used nonionogenic surfactants are polyoxypropylene esters.

In addition to surfactants and optionally inert standardizing agents, auxiliaries may also be added. Auxiliaries are understood as meaning, for example, antioxidants, free radical scavengers, UV absorbers, light stabilizers, chelating agents, whey or modified starch, as are known from the prior art. Preferably, no auxiliaries are used for the application in the liquor.

Solid formulations are in general particularly expedient since they can be easily removed from the containers and metered, where there is no need for complicated cleaning of containers. Solid formulations furthermore have the advantage that they are generally stable for longer on storage than liquid formulations.

The invention therefore furthermore relates to a composition containing D-isoascorbic acid or one of its salts and at least one surfactant. Expediently, such a composition contains 20-90, preferably 70-85, % by weight of D-isoascorbic acid or of one of its salts and 10-80, preferably 15-30, % by weight of a surfactant or of a surfactant mixture. The percentages by weight sum to 100% by weight.

These compositions, optionally supplemented with an inert standardizing agent and/or an auxiliary with adaptation of the expedient amounts for use as solid formulation or in dissolved form based on water, are particularly suitable for use in the process according to the invention.

The invention therefore furthermore relates to a process characterized in that D-isoascorbic acid is added to the liquor in the form of a composition comprising D-isoascorbic acid or one of its salts, at least one surfactant and optionally an inert standardizing agent and/or an auxiliary as a solid formulation, or said solid formulation in the form of its solutions or concentrates substantially based in water.

Nonaqueous solid compositions, i.e. solid formulations comprising the components a), b) and optionally c), but dispensing with an auxiliary, are preferred for use in liquors.

The invention therefore furthermore relates to a process in which D-isoascorbic acid is added to the liquor in the form of a solid composition, comprising a) D-isoascorbic acid or one of its salts, b) at least one surfactant and c) optionally an inert standardizing agent.

The component a) may be present in an amount of 20 to 90, preferably 25 to 65, % by weight. The surfactant b) may be present in an amount of 1 to 20, preferably 5 to 15, % by weight. A standardizing agent c) may be present in an amount of 9 to 80, preferably 28 to 70, % by weight. The percentages by weight sum to 100% by weight.

A very particularly preferred solid composition comprises a) 35 to 50% by weight of D-isoascorbic acid or of one of its salts, b) 5 to 10% by weight of a surfactant or a surfactant mixture and c) 45 to 60% by weight of an inert standardizing agent, the percentages by weight summing to 100% by weight.

Such a solid formulation can be prepared by simply combining and mixing the individual components, the surfactant or the surfactant mixture expediently being used in powder form.

By adding water and optionally organic solvents, solutions and concentrates based on water can be prepared from such solid formulations.

The D-isoascorbic acid or one of its salts is also outstandingly suitable as an agent for the subsequent treatment of already completely finished leather tanned with Cr(III) salts, and commodity articles produced therefrom, for reducing the amount of Cr(VI) compounds. The aftertreatment may serve for prevention since it is known that Cr(VI) compounds also form during the use of the leather articles. In particular, however, the aftertreatment serves for preventing damage which may arise as a result of excessively high Cr(VI) contents being found in leather blanks which are to be used for further processing, but also in already finished leather articles, and thus preventing further use or marketing.

A further embodiment of the process according to the invention is therefore a process for reducing the amount of Cr(VI) compounds in a finally finished article which was produced completely or partly from leather tanned with Cr(III) salts, characterized in that the leather or the leather parts is or are brought into contact with a substantially aqueous solution containing D-isoascorbic acid or one of its salts and said solution is allowed to act on the leather.

The compositions can be applied, for example, to the surface of the articles, for example by rolling on or spraying on, or the article can be immersed in liquid formulations or the latter are allowed to act on the article. The effective concentration, as far as formulations are concerned, of D-isoascorbic acid or of one of its salts in the solution should be at least 0.8, preferably at least 1.2, particularly preferably at least 2, %, based on the solution.

Compositions based on water may expediently additionally contain water-soluble organic solvents, for example alcohols, such as methanol, ethanol, propanol or isopropanol, if they are to be used, for example, as sprayable compositions.

Agents which in principle are suitable for the aftertreatment are the solid formulations described above, dissolved in water and with addition of an organic solvent.

Such an agent suitable for an aftertreatment process according to the invention is therefore a composition based on water and containing D-isoascorbic acid or one of its salts, a surfactant, an organic solvent and optionally a standardizing agent and/or an auxiliary.

The invention therefore furthermore relates to an agent for use for the aftertreatment of an article which was produced completely or partly from leather tanned with Cr(III) salts, in the form of a composition comprising d) D-isoascorbic acid or one of its salts, e) at least one surfactant, f) water, g) an organic solvent and h) optionally an inert standardizing agent and/or auxiliary.

The surfactants already described above, as an individual component or as a surfactant mixture, are suitable as a surfactant. The standardizing agents already described above are suitable as an optional standardizing agent. The auxiliaries mentioned above are suitable as optional auxiliaries. In order to stabilize an aqueous composition according to the invention for storage purposes, the pH of the composition should also be checked and, if appropriate, adjusted to pH of at least 6 or above by, for example, addition of alkali. For storage purposes, it is also expedient to pack aqueous compositions in an air-tight manner protected from light.

Alcohols, in particular ethanol and propanol, are preferably used as organic solvent.

In order to achieve a sufficient effect, an aqueous solution should be at least a 2% strength solution of D-isoascorbic acid or of one of its salts.

In a practical embodiment, a solid formulation containing D-isoascorbic acid or one of its salts and a surfactant or a surfactant mixture is prepared before use with water and an alcohol to give an aqueous and sprayable formulation and is then sprayed onto the desired parts of the article.

As already mentioned, such solutions are suitable in particular for the aftertreatment of articles for which intensive and/or prolonged skin contacts are to be expected, for example work gloves. Even if no elevated Cr(VI) content was initially directly detectable in such articles, an increase in the Cr(VI) content might be expected with increasing duration of use. An aftertreatment with the aqueous solutions described above before an article is used for the first time and at certain time intervals during use may therefore be advantageous as a preventive measure.

Excessively high Cr(VI) contents can be effectively reduced in such a way that specified limits are not exceeded. Thus, an effective aftertreatment agent which is suitable in particular for the treatment of leather articles in the production of which little attention or no attention at all has been paid to the formation of Cr(VI) is available.

The invention also relates to the use of D-isoascorbic acid or of one of its salts as such or as a constituent of a liquid or solid formulation for reducing the amount of Cr(VI) compounds in leathers tanned with Cr(III) salts.

The use, according to the invention, of D-isoascorbic acid proves to be effective, simple in application and economical, no discolouration of the treated leathers and articles and no impairment of the leather properties being observed.

The following examples explain the invention in more detail.

EXAMPLES

For the following two examples, two different recipes were chosen for the production of safety gloves from split leather. For examples 1 and 2, in each case fatliquoring agents which represent a combination of a natural and a synthetic fatliquoring agent were used, the natural fatliquoring agent in example 2 having higher proportions of unsaturated radicals.

The following commercial products from TFL Ledertechnik GmbH were used:

Borron® SAF (detergent based on alkyl ether sulphate),
Chromopol® UFB/W (combination of natural and synthetic fatliquoring agents),
Chromopol® SG (natural fatliquoring agent),
Sellatan® RL fl. (synthetic aromatic tanning agent),
Coripol® MK (combination of natural and synthetic fatliquoring agents).

Example 1

Example 1 illustrates the comparison between ascorbic acid and D-isoascorbic acid, which were used in each case as agents in the same concentration, both in direct pure pulverulent form (agents A and B) and in formulated form as pulverulent solid formulation (agents C and D) in comparative final wash processes (wet end) in the production of a glove leather.

Samples of a chrome-tanned cattle split leather (wet blue) were used as starting material. The wet blue was shaved to a thickness of 1.0-1.1 cm and further processed to give a safety glove leather. The stated percentages are based on the shaved weight. Table 1a reproduces the production process and the agents used for this purpose in table form.

TABLE 1a

| Process | [%] | | Time [min] | pH |
|---|---|---|---|---|
| Washing | 300 | water, 35° C. | | |
| | 0.3 | Borron ® SAF | 30 | |
| Neutralization | 150 | water, 35° C. | | |
| Retanning/ | 1.5 | sodium bicarbonate | 30 | |
| fatliquoring | 4 | Chromopol ® UFB/W | | |
| | 1.5 | sodium bicarbonate | 60 | 6.8 |
| | 6 | Sellatan ® RL liquid | 30 | |
| | 100 | water, 50° C. | | |
| | 6 | Coripol ® MK | | |
| | 4 | Chromopol ® UFB/W | 60 | |
| | 1 | formic acid, 85% | 10 | |
| | 1.5 | formic acid, 85% | 10 | |
| | 1.5 | formic acid, 85% | 20 | 3.6 |
| Washing | 300 | water, 25° C. | 10 | |
| Washing with: | 150 | water, 25° C. | | |
| Agent A | 1.5 | L-ascorbic acid 100% (powder) | 30 | 3.2 |
| Agent B | 1.5 | D-isoascorbic acid 100% (powder) | 30 | 3.3 |
| Agent C | 2.0 | L-ascorbic acid 40% (powder formulation) | 30 | 3.4 |
| Agent C | 3.0 | L-ascorbic acid 40% (powder formulation) | 30 | 3.5 |
| Agent D | 2.0 | D-isoascorbic acid 40% (powder form.) | 30 | 3.4 |
| Agent D | 3.0 | D-isoascorbic acid 40% (powder form.) | 30 | 3.5 |

Agent D is a solid formulation according to the invention having a composition (100% by weight) consisting of:

53% by weight of standardizing agent,

2% by weight of sodium alkylbenzenesulphonate,

5% by weight of an ethoxylated $C_{18}$-fatty alcohol,

40% by weight of D-isoascorbic acid.

Agent C differs from agent D only through the use of 40% by weight of L-ascorbic acid instead of D-isoascorbic acid.

The washed leathers are then completed (setting out on trestle overnight, air drying, conditioning, staking and milling). In the case of the leathers completed in this manner, the Cr(VI) content was determined according to DIN 53314, a comparative group being subjected to artificial ageing by a treatment for three days at 100° C. according to EN ISO 17228. The purpose of this standard is to obtain information as to how the colour of the leather surface, but also the leather itself, would change with time as a result of ageing and environmental influences (yellowing). The results are shown in table 1b.

TABLE 1b

| Agent | Antioxidant effectively | Without ageing Cr(VI) | Without ageing dyeing | Artificial ageing Cr(VI) | Artificial ageing dyeing |
|---|---|---|---|---|---|
| Agent A (1.5%) | 1.5% | <3 ppm | white/beige | <3 ppm | beige/greenish + red tinge |

TABLE 1b-continued

| Agent | Antioxidant effectively | Without ageing Cr(VI) | Without ageing dyeing | Artificial ageing Cr(VI) | Artificial ageing dyeing |
|---|---|---|---|---|---|
| Agent B (1.5%) | 1.5% | <3 ppm | white/beige | <3 ppm | beige/greenish |
| Agent C (2%) | 0.8% | <3 ppm | white/beige | <3 ppm | beige/greenish |
| Agent C (3%) | 1.2% | <3 ppm | white/beige | <3 ppm | beige/greenish + red tinge |
| Agent D (2%) | 0.8% | <3 ppm | white/beige | <3 ppm | beige/greenish |
| Agent D (3%) | 1.2% | <3 ppm | white/beige | <3 ppm | beige/greenish |

Even after the artificial ageing (72 h at 100° C.), no increase in the Cr(VI) content to above the limit of detection could be found in the comparative group. While the expected slight "yellowing", i.e. a slight change in the shade, was detectable in all samples, the samples treated with the L-ascorbic acid-containing agents A and C additionally had a slight red tinge (only at the higher concentration in the case of agent C), while the D-isoascorbic acid-containing agents B and D proved to be colour-stable.

Example 2

Example 2 once again illustrates a comparison between ascorbic acid and D-isoascorbic acid, which were used as agents C and D in different concentrations in formulated form in comparative final wash processes (wet end) in the production of a glove leather, the agents C and D being identical to example 1.

Once again, samples of a chrome-tanned cattle split leather (wet blue) were used as starting material. The wet blue was shaved to a thickness of 1.0-1.1 cm and further processed to give a safety glove leather. The stated percentages are based on shaved weight. Table 2a reproduces the production process and the agents used for this purpose in table 2a. It is a recipe modified compared with example 1 substantially in that a Cr(III) retanning was additionally carried out.

TABLE 2a

| Process | [%] | | Time [min] | pH |
|---|---|---|---|---|
| Cr retanning | 300 | water, 35° C. | | |
| | 4 | chromium, 33% basicity | 120 | 3.3 |
| Washing | 300 | water, 35° C. | 10 | |
| Neutralization | 150 | water, 35° C. | | |
| Retanning/ | 1 | sodium bicarbonate | 30 | |
| | 4 | Chromopol ® SG | | |
| | 2 | sodium bicarbonate | 60 | 6.3 |
| | 6 | Sellatan ® RL fl. | 60 | |
| | 1 | formic acid, 85% | 10 | |
| | 1 | formic acid, 85% | 20 | 3.6 |
| Washing | 300 | water, 50° C. | 10 | |
| Fatliquoring | 100 | water, 50° C. | | |
| | 1 | ammonia | 10 | |
| | 6 | Coripol ® MK | | |

TABLE 2a-continued

| Process | [%] | | Time [min] | pH |
|---|---|---|---|---|
| | 4 | Chromopol ® SG | 60 | |
| | 1 | formic acid, 85% | 10 | |
| | 1 | formic acid, 85% | 20 | 3.5 |
| Washing | 300 | water, 25° C. | 10 | |
| Washing with: | 150 | water, 25° C. | | |
| without/with agent | | see details in tables 2b, c, d | 30 | |

The washed leathers were then completed (setting out on a trestle overnight, air drying, conditioning, staking and milling). In the case of the leathers completed in this manner, once again the Cr(VI) content was determined according to DIN 53314, a comparative group being subjected to artificial ageing by treatment for three days at 100° C. The results are shown in table 2b:

TABLE 2b

| Agent | Antioxidant effectively | Without ageing Cr(VI) | Without ageing dyeing | Artificial ageing Cr(VI) | Artificial ageing dyeing |
|---|---|---|---|---|---|
| none | — | <3 ppm | white/beige | 18.8 | white/greenish |
| Agent D (1%) | 0.4% | <3 ppm | white/beige | 10.1 ppm | white/greenish |
| Agent D (2%) | 0.8% | <3 ppm | white/beige | 8.4 ppm | white/greenish |
| Agent D (3%) | 1.2% | <3 ppm | white/beige | <3 ppm | white/greenish |

Without addition of an agent, a substantial increase in the Cr(VI) content is to be found after the artificial ageing. According to the results, a certain minimum concentration of the agent according to the invention is required in order for the content of Cr(VI) to fall below the limit of detection. In the examples cited, it is achieved that an effective amount of about 0.9-1.2% of D-isoascorbic acid is reached and thus reaches about the same effectiveness as L-ascorbic acid.

Example 2 was repeated. The details are shown in table 2c below:

TABLE 2c

| Agent | Antioxidant effectively | Without ageing Cr(VI) | Artificial ageing Cr(VI) |
|---|---|---|---|
| none | — | <3 ppm | 11.3 |
| Agent C (3%) | 1.2% | <3 ppm | <3 ppm |
| Agent D (3%) | 1.2% | <3 ppm | <3 ppm |
| Agent D (3%) | 1.2% | <3 ppm | <3 ppm |

For agent D, D-isoascorbic acid from another manufacturer in each case was used. In both cases, as previously, an effective amount of 1.2% of D-isoascorbic acid was sufficient to reduce the value to below the limit of detection. The comparable effectiveness of agents C and D was once again found.

Example 2 was repeated a further time. The details and results are shown in table 2d below:

TABLE 2d

| Agent | Antioxidant effectively | Without ageing Cr(VI) | Artificial ageing Cr(VI) |
|---|---|---|---|
| none | — | <3 ppm | 24.5 |
| Agent D (3%) | 1.2% | <3 ppm | <3 ppm |
| Agent D (4%) | 1.6% | <3 ppm | <3 ppm |
| Agent D (6%) | 2.4% | <3 ppm | <3 ppm |

In this experiment, too, an effective amount of 1.2% of D-isoascorbic acid was sufficient to reduce the Cr(VI) values after the artificial ageing to values below the limit of detection.

Example 3

This example was identical to example 2 with regard to the agents used and concerns the process for leather production. In contrast to example 2, in the final wet end process, the duration for the agent to act on the leather was increased from 30 to 60 minutes here.

The details are summarized in table 3a:

TABLE 3a

| Process | [%] | | Time [min] | pH |
|---|---|---|---|---|
| Cr retanning | 300 | water, 35° C. | | |
| | 4 | chromium 33% basicity | 120 | 3.3 |
| Washing | 300 | water, 35° C. | 10 | |
| Neutralization | 150 | water, 35° C. | | |
| Retanning/ | 1 | sodium bicarbonate | 30 | |
| . . . and so on | | . . . as in example 2 | | |
| Washing | 300 | water, 50° C. | 10 | |
| Fatliquoring | 100 | water, 50° C. | | |
| . . . and so on | | . . . as in example 2 | | |
| Washing | 300 | water, 25° C. | 10 | |
| Washing | 150 | water, 25° C. | | |
| without/with agent | | see details in table 3b | 60 | |

The washed leathers are then completed (setting out on a trestle overnight, air drying, conditioning, staking and milling). In the case of the leathers completed in this manner, once again the Cr(VI) content was determined according to DIN 53314, a comparative group being subjected to artificial ageing by treatment for three days at 100° C. The results are shown in table 3b:

TABLE 3b

| Agent | Antioxidant effectively | Without ageing Cr(VI) | Artificial ageing Cr(VI) |
|---|---|---|---|
| none | — | <3 ppm | 19.8 |
| Agent A (0.5%) | 0.5% | <3 ppm | <3 ppm |
| Agent A (1.0%) | 1.0% | <3 ppm | <3 ppm |
| Agent D (2.0%) | 0.8% | <3 ppm | 10.2 ppm |
| Agent D (3.0%) | 1.2% | <3 ppm | <3 ppm |

The results of the artificial ageing confirm that a certain minimum concentration of the agent according to the invention is required in order for the content of Cr(VI) to fall below the limit of detection. D-isoascorbic acid shows a tendency to be somewhat less effective than L-ascorbic acid, where the difference is to be regarded as slight. The contact time of the agents in the wet end step is twice as long in comparison with the preceding examples and evidently leads to no further improvement.

In summary, it may be said with regard to examples 2 and 3 that initially no Cr(VI) can be found in measurable amounts in leathers which were tanned with Cr(III) salts and produced by modern processes. Even if an attempt is made to force increased Cr(VI) formation directly by the production process in which additional retanning with Cr(III) was carried out, and the fatliquoring agent also has unsaturated fractions, the attempt is not successful. However, all examples show a substantial increase in the Cr(VI) content to above the limit of detection after artificial accelerated ageing. This is also the case in example 1, although here, in contrast to examples 2 and 3, no Cr(III) retanning was carried out.

However, the very simple application and handling of D-isoascorbic acid by addition in the final wash process of the wet finishing proved to be a very effective means of reducing the amount of Cr(VI) in both cases of the process.

Example 4

This example relates to the aftertreatment of a leather-containing article containing Cr(III)-tanned leather, in which Cr(VI) was found above the limit of detection of 3 mg/kg of dry substance. This article was an already dyed punched leather blank, for example suitable for manufacturing safety gloves or leather shoes.

For the aftertreatment, a concentrated solution was used, comprising

10% by weight of D-isoascorbic acid, 1% by weight of surfactant, 5% by weight of isopropanol, 84% by weight of water, together 100% by weight as agent E, and 10% by weight of L-ascorbic acid, 1% by weight of surfactant, 5% by weight of isopropanol, 84% by weight of water, together 100% by weight as agent F, diluted with water to such an extent that a 2% strength solution was present in each case. The pH was 3.2 for the 2% strength solution.

Various samples were briefly sprayed in each case twice, once with agent E and once with agent F (spraying on briefly, allowing to partially dry, spraying on again briefly). The Cr(VI) content was determined for an untreated sample and the treated samples before and after the artificial accelerated ageing (3 days at 100° C.). The measured values are shown in table 4:

TABLE 4

| Agent | Antioxidant effectively | Without ageing Cr(VI) | Artificial ageing Cr(VI) |
|---|---|---|---|
| none | — | 3 ppm | 27.8 ppm |
| Agent E (2%) | 2% | <3 ppm | <3 ppm |
| Agent F (2%) | 2% | <3 ppm | <3 ppm |

Prior to the artificial ageing, the leather sample had a just detectable Cr(VI) content, which however increased to a value substantially above the limit of detection as a result of the artificial ageing. The excessively high Cr(VI) content could be reduced to below the limit of detection both with L-ascorbic acid and with D-isoascorbic acid.

The invention claimed is:

1. A process for reducing the amount of Cr(VI) compounds in leathers tanned with Cr(III) salts, wherein, after the tanning, at least 1.2% by weight of free D-isoascorbic acid or of one of its salts is allowed to act on the leather in aqueous liquor, based on the shaved weight of the leather, wherein D-isoascorbic acid is added to the liquor in the form of a composition comprising D-isoascorbic acid or one of its salts, at least one surfactant and an inert standardizing agent, and wherein after artificial aging by a treatment for three days at 100° C. according to EN ISO 17228, no red tinge is detected on the treated leather.

2. The process according to claim 1, wherein an auxiliary is added to the liquor as a solid formulation, or said solid formulation is added in the form of its solutions or concentrates substantially based on water.

3. The process according to claim 2, wherein D-isoascorbic acid is added to the liquor in the form of a solid composition.

4. The process according to claim 3, wherein D-isoascorbic acid is added to the liquor in the form of a solid composition comprising a) 20 to 90% by weight of D-isoascorbic acid or of one of its salts, b) 1 to 20% by weight of a surfactant or of a surfactant mixture, and c) 9 to 80% by weight of an inert standardizing agent, the percentages by weight summing to 100% by weight.

5. The process according to claim 1, wherein D-isoascorbic acid is added to the liquor at the end of wet finishing, and is allowed to act on the chrome-tanned leather for at least 30 minutes.

6. The process according to claim 1, wherein sodium isoascorbate is used as the salt of D-isoascorbic acid.

7. The process according to claim 2, wherein D-isoascorbic acid is added to the liquor at the end of wet finishing, and is allowed to act on the chrome-tanned leather for at least 30 minutes.

8. The process according to claim 3, wherein D-isoascorbic acid is added to the liquor at the end of wet finishing, and is allowed to act on the chrome-tanned leather for at least 30 minutes.

9. The process according to claim 4, wherein D-isoascorbic acid is added to the liquor at the end of wet finishing, and is allowed to act on the chrome-tanned leather for at least 30 minutes.

* * * * *